US006726545B2

(12) United States Patent
Balakumar et al.

(10) Patent No.: US 6,726,545 B2
(45) Date of Patent: Apr. 27, 2004

(54) LINEAR POLISHING FOR IMPROVING SUBSTRATE UNIFORMITY

(75) Inventors: Subramanian Balakumar, Singapore (SG); Chen Feng, Singapore (SG); Victor Lim, Singapore (SG); Paul Proctor, Singapore (SG); Mukhopadhyay Madhusudan, Singapore (SG); Chivukula Subrahmanyam, Singapore (SG); Yelehanka Ramachandramurthy Pradeep, Singapore (SG)

(73) Assignee: Chartered Semiconductor Manufacturing Ltd., Singapore (SG)

( * ) Notice: Subject to any disclaimer, the term of this patent is extended or adjusted under 35 U.S.C. 154(b) by 96 days.

(21) Appl. No.: 10/134,821

(22) Filed: Apr. 26, 2002

(65) Prior Publication Data

US 2003/0203710 A1 Oct. 30, 2003

(51) Int. Cl.[7] ..... B24B 1/00

(52) U.S. Cl. ..... 451/59; 451/36; 451/296; 451/297; 451/287; 451/289; 451/303

(58) Field of Search ..... 451/59, 36, 296, 451/297, 287, 289, 303, 307, 41, 288, 5, 8

(56) References Cited

U.S. PATENT DOCUMENTS

| | | | | | |
|---|---|---|---|---|---|
| 5,016,400 | A | * | 5/1991 | Shendon | 451/303 |
| 5,435,772 | A | | 7/1995 | Yu | 451/63 |
| 5,503,592 | A | | 4/1996 | Neumann | 451/278 |
| 5,575,707 | A | * | 11/1996 | Talieh et al. | 451/173 |
| 5,593,344 | A | * | 1/1997 | Weldon et al. | 451/296 |
| 5,899,745 | A | | 5/1999 | Kim et al. | 438/692 |
| 6,231,427 | B1 | | 5/2001 | Talieh et al. | 451/41 |
| 6,248,006 | B1 | | 6/2001 | Mukhopadhyay et al. | 451/285 |
| 6,264,789 | B1 | | 7/2001 | Pandey et al. | 156/345 |
| 6,336,851 | B1 | * | 1/2002 | Weber | 51/141 |
| 6,416,385 | B2 | * | 7/2002 | Ferri, Jr. et al. | 451/10 |
| 6,428,394 | B1 | * | 8/2002 | Mooring et al. | 451/41 |
| 6,520,843 | B1 | * | 2/2003 | Halley | 451/285 |
| 6,572,463 | B1 | * | 6/2003 | Xu et al. | 451/526 |
| 6,607,425 | B1 | * | 8/2003 | Kistler et al. | 451/41 |

* cited by examiner

*Primary Examiner*—Joseph J. Hail, III
*Assistant Examiner*—Alvin J Grant
(74) *Attorney, Agent, or Firm*—George O. Saile; Rosemary L. S. Pike

(57) ABSTRACT

A linear polishing apparatus for polishing a semiconductor substrate including a novel polishing belt arrangement with at least two polishing belts forming a continuous loop. Each belt having an outside polishing surface and an inside smooth surface. The belts are spaced alongside each other sharing a common axis at each end. The belts are looped around a pair of rollers making up a driver roller at one end and a driven roller at the other end. A platen member interposes each belt and is placed between the pairs of rollers. The platen provides a polishing plane and supporting surface for the polishing belts. The polishing plane includes a plurality of holes communicating with an elongated plenum chamber underlying the plane. The chamber supplies a compressed gas to impart an upward pressure against the polishing belts. The driver rollers are coupled to separate motors to independently drive and control at least said two of the polishing belts.

25 Claims, 4 Drawing Sheets

LINEAR POLISHING FOR IMPROVING SUBSTRATE UNIFORMITY

BACKGROUND OF THE INVENTION (1) Technical Field

This invention relates generally to an apparatus and method for making integrated circuits and more particularly, the invention relates to linear platens and polishing belts for chemical mechanical polishing (CMP) of substrates and its capacity to improve the substrate's within wafer nonuniformity (WIWNU).

(2) Description of the Prior Art

The following documents relate to methods dealing with chemical mechanical polishing of integrated circuits formed on semiconductor wafers.

U.S. Pat. No. 6,231,427 B1 issued May 15, 2001 to H Talieh et al. shows a linear CMP Tool.

U.S. Pat. No. 6,248,006 B1 issued Jun. 19, 2001 to M. Madhusudan et al. discloses a split multi padded rotary platen for a CMP tool.

The fabrication of integrated circuits on a semiconductor wafer involves a number of steps where patterns are transferred from photolithographic photomasks onto the wafer. The photomasking processing steps opens selected areas to be exposed on the wafer for subsequent processes such as inclusion of impurities, oxidation, or etching.

During the forming of integrated circuit structures, it has become increasingly important to provide structures having multiple metallization layers due to the continuing miniaturization of the circuit elements in the structure. Each of the metal layers is typically separated from another metal layer by an insulation layer, such as an oxide layer. To enhance the quality of an overlying metallization layer, one without discontinuities of other blemishes, it is imperative to provide an underlying surface for the metallization layer that is ideally planar. The process of planarizing is now a standard process application of integrated circuit manufacturers.

Plasma or reactive ion etching of the oxide layers having a resist-planarizing medium, is conventional planarization techniques that are used to provide a smooth surface and a local planarization with a range of 1 um.

To meet the demand for larger scale integration, and more metal and oxide layers in devices and the exacting depth of focus needed for submicron lithography, a new planarization method, known as chemical mechanical polishing (CMP), was developed and is presently used by most major semiconductor manufacturers. CMP planarization of a wafer involves supporting and holding the wafer against a rotating polishing pad wet with polishing slurry and at the same time applying pressure. Unlike the conventional planarization techniques, CMP provides a substantially improved overall planarization, that is, an improvement of 2 to 3 orders of magnitude over conventional methods.

CMP enables technology for submicron design rules because it has excellent planarization capacity to meet the stringent lithography requirements. Therefore, it has emerged as an essential process for multilevel interconnection of ULSI chip fabrication. However, poor understanding of polishing phenomena makes it difficult to achieve local and global uniformity. The fundamental consideration of pad properties and motions to achieve global planarization of IC wafers is extremely crucial. The factors effecting WIWNU are material removal rate, planarity and polished surface quality. Among these factors, the polishing pad plays an important role in the CMP process. The role of the polishing pad is the transportation of slurry to the polishing reaction point and how the pad responds to and supports the downward force applied by the wafer-polishing head. Moreover, the pad transfers a shear force of the slurry to the wafer surface and needs to eliminate the polished residue from the polishing point to aid the new polishing reaction. As a result of these effects, properties and behavior of a polishing pad directly affects polishing results.

The polishing pad behaves as being elastic and viscoelastic under applied pressure and this phenomenon affects the WIWNU or planarity. The combination of different belts having different properties such as, percentage of rebound, percentage of compressibility and degree of hardness, would give an overall increase in polishing uniformity. This is based on a soft pad providing better global planarization with poor local planarity, while a hard pad shows better local planarity with poor global planarization.

Therefore, a need exists for a polishing apparatus and method for permitting CMP operations to be done on a semiconductor substrate under controlled process conditions for planarizing particular zones on the substrate while oscillating on several polishing belts simultaneously. Each of the polishing belts having different degrees of hardness, compressibility, percentage of rebound and speeds. The foregoing combination to improve the WIWNU.

SUMMARY OF THE INVENTION

A principal object of the invention is to provide a method and apparatus for improving WIWNU, or planarity, using an improved chemical mechanical polishing apparatus for planarizing semiconductor substrates.

Another object of the invention is to provide an apparatus for polishing semiconductor substrates using at least two linear platens for supporting at least two polishing belts having different properties, and to polish with or without an abrasive slurry, so that the best attribute from each belt is used for improving overall global and local planarity of the polished substrate.

Still another object of the invention is to provide at least two adjustable drives for driving each polishing belt at different linear velocities.

Yet another object of the invention is to oscillate the substrate over the selected polishing belts to fix the end point for the desired profile.

Yet, still another object of the invention is to provide pressure control under each belt to increase the polishing rate.

Since a polishing pad behaves as being elastic and viscoelastic under applied pressure which affects the overall planarity of the substrate. Viscoelastic behavior of polymeric pad is considered an important factor affecting polishing results. The combination of different belt pads having different properties such as, percentage of rebound, percentage of compressibility and degree of hardness, would give an overall increase in polishing uniformity. This, as explained before, is partly based on the soft pad providing better global planarization with poor local planarity, while the hard pad does just the opposite. A need exists, therefore, for a polishing apparatus and method for permitting CMP operations to be done on a semiconductor substrate under known and controlled polishing conditions.

A linear polishing apparatus for polishing a semiconductor substrate including a novel polishing belt arrangement with at least two polishing belts forming a continuous loop. Each belt having an outside polishing surface and an inside smooth surface. The belts are spaced alongside each other sharing a common axis at each end. The belts are looped around a pair of rollers making up a driver roller at one end and a driven roller at the other end. A platen member interposes each belt and is placed between the pairs of rollers. The platen provides a polishing plane and supporting surface for the polishing belts. The polishing plane includes a plurality of holes communicating with an elongated plenum chamber underlying the plane. The chamber supplies a compressed gas to impart an upward pressure against the polishing belts. The driver rollers are coupled to motors to independently drive and control at least two of the polishing belts.

Therefore, an apparatus and method is provided for improving the WIWNU conditions by planarizing particular areas on the substrate while oscillating on several polishing belts simultaneously with each belt having different degrees of hardness, compressibility, percentage of rebound and speeds.

Other features and advantages of the present invention will be apparent from the accompanying drawings and from the detailed description that follow

DETAILED DESCRIPTION OF THE PREFERRED EMBODIMENT

The present invention includes an improved apparatus and method for chemically mechanically polishing the top surface of a semiconductor substrate. The polishing apparatus is provided for improving WIWNU conditions by planarizing particular areas on the substrate while moving back and forth on several polishing belts. The process conditions are adapted where each belt is selected from a group of standard polishing belts having different properties such as percent of rebound, hardness and compressibility. The present invention provides the user with a variety of options to improve center to periphery uniformity, that is, by planarizing using either a dry CMP or a wet (slurry) process, the option of choosing different belt speeds for each belt while controlling the breadth and frequency of oscillation and rotation of the substrate with respect to the polishing belts, and the ability to apply a controlled pressure to the substrate from both top and bottom directions.

Figure 1:
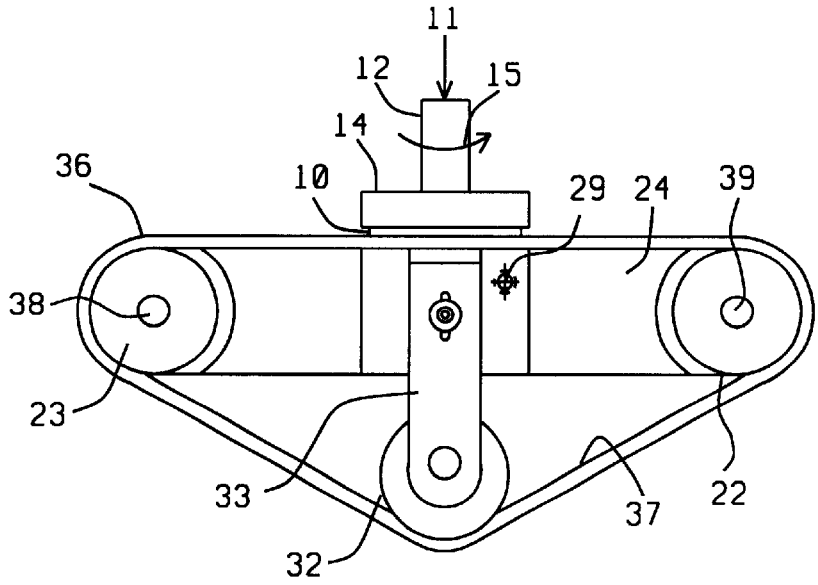
FIG. 1 is an illustration of a side view of a linear CMP tool of the invention.

Reference will now be made in detail to the apparatus illustrated in the accompanying figures. Referring now to the drawings, where the same reference numbers throughout the illustrations designated. Attention is directed to FIG. 1 showing a typical belt arrangement as viewing the apparatus from its side. An endless belt 20 encircling three parallel rollers 22, 23 and 32, together forming a triangular profile. Roller 32 is conventionally known as a free rolling idler used for taking-up belt slack by adjusting member 33 in a downward direction against the inside surface 37 of belt 20. Roller shafts 38 and 39 extend from one end of a roller through the other end, and into load bearing supports provided at each end.

Extending the foregoing embodiment for improving WIWNU, a novel application is described using at least two coplanar polishing belts, positioned side by side with a gap between, and at least two of the polishing belts driven independently.

FIG. 1 includes a polishing head 14 having a lower surface opposed to the upper surface of the polishing belt 20. The lower surface holds a substrate 10 to be polished. An elastomeric material (not shown) having cohesive properties is used on the bottom surface of the polishing head 14 to adhere and hold the substrate 10 to the polishing head. The polishing head 14 is mounted to a rotating shaft 12 and is rotationally driven by the rotating shaft. The polishing head 14 rotates and oscillates the substrate. Rotation is indicated by arrow 15. Both rotational speed and degree of oscillation are each variable and controllable. A force 11 is also applied in the downward vertical direction against substrate 10 and presses the substrate against the moving polishing belts as the substrate is being rotated and oscillated during polishing. The force is typically in the order of between 0 and 15 psi and is applied by means of the rotating shaft 15 that is attached to the back of substrate polishing head 14.

Figure 2:
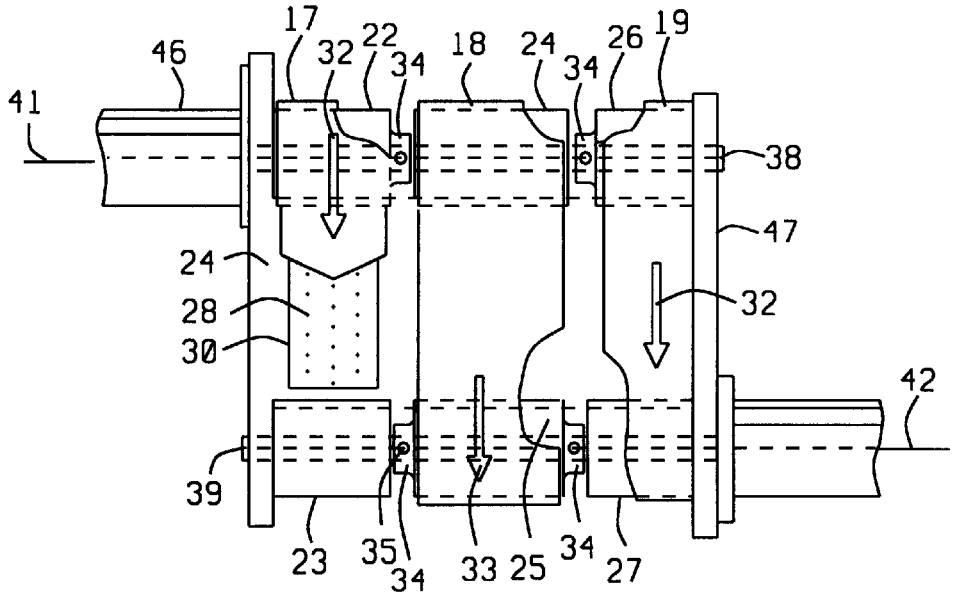
FIG. 2 illustrates a top view of the invention showing a multiple polishing belt drive arrangement of the invention.
Figure 3:
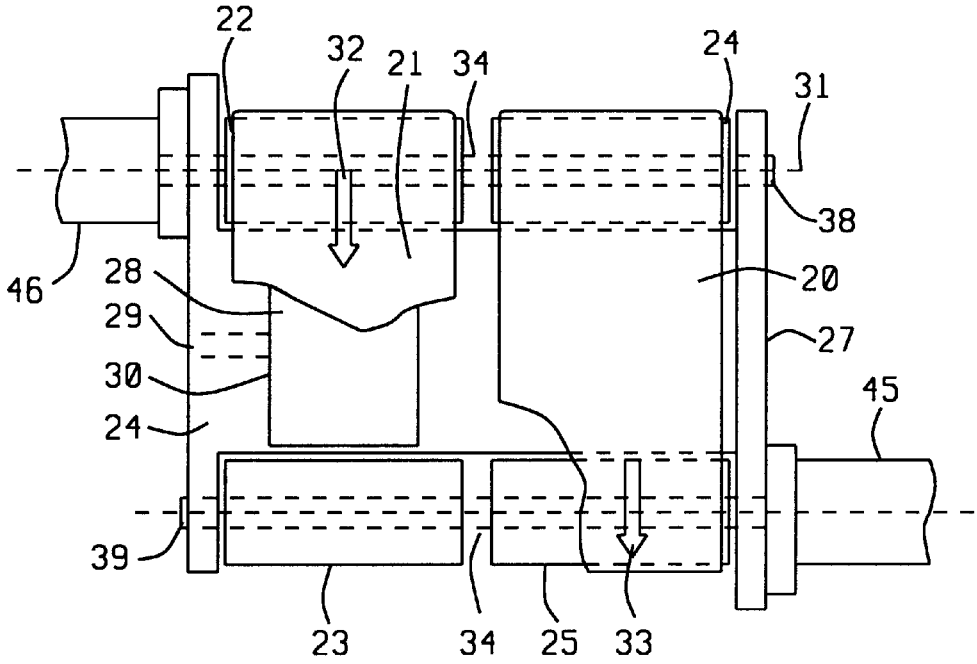
FIG. 3 illustrates a top view of the invention showing another multiple polishing belt drive arrangement of the invention.

In a further application of the invention, parallel drive shafts 38 and 39 are extended through other neighboring rollers as shown in FIGS. 2 through 7. A platen 24 is mounted between rollers 22 and 23 supporting the inside surface 37 for the upper belt member as best illustrated in FIG. 1. The drive shafts 38 and 39 are supported at one end by bearing plate 27 and the other end by platen member 24. This is best illustrated in FIGS. 2 and 3.

Figure 4:
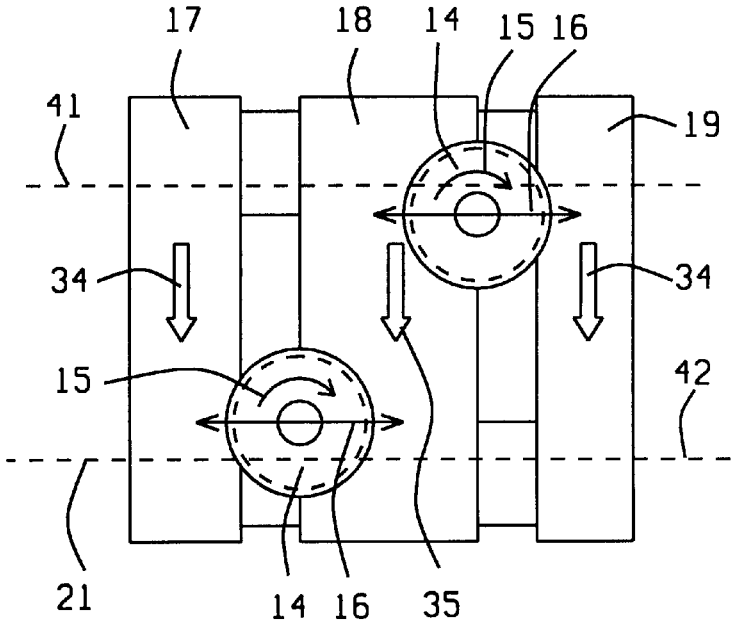
FIG. 4 is a schematic top view of FIG. 2 showing the polishing applications with multiple substrate polishing heads of the invention.

FIGS. 2–7 show various views, of the invention, illustrating novel linear polishing arrangements for polishing a semiconductor substrate. In a first embodiment shown in FIGS.2, 4 and 6, revealing various views of a polishing apparatus with at least three polishing belts 17, 18, and 19. Each belt having an outside polishing surface and an inside driving surface. Referring specifically to FIGS. 2 and 4, showing a top view of the invention, the belts are spaced alongside each other while sharing common and parallel axes 41 and 42 that are distally positioned. Polishing belts 17 and 19 may be functionally identical or may differ in its degrees of hardness, compressibility or percentage of rebound. Each belt is looped around a pair of rollers, 22, 23 and 26, 27. Rollers 22 and 26 are fixed to a rotatable drive shaft 38 that is coupled to a drive motor 46 at the axial position 41. Rollers 23 and 27 freely rotate on shaft 39. Drive motor 46, a variable speed motor, drives both polishing belts 17 and 19. A third polishing belt 18, looped around driver roller 25 and driven roller 24, is positioned between belts 17,19 Belt 18 is driven by driver roller 25 fixed to drive shaft 39 that is coupled to drive motor 42, also a variable speed motor.

A platen 24 interposes each belt and is placed between the pairs of rollers. The platen 24 provides a polishing plane and supporting surface for the polishing belts 17, 18, and 19. The polishing plane includes a plurality of holes 28 underlying each belt, the holes communicate with separately supplied elongated plenum chambers 30 underlying the polishing plane, each plenum chamber delivers an adjustable and regulated compressible gas to provide a different upward pressure against each polishing belt 17, 18, and 19. The purpose is to provide a pressure from under the substrate to better control the overall WIWNU. The exhausting gas also provides a lubricating bearing surface for reducing frictional drag between the polishing belts and platen 24.

A predetermined gap separates the belts. The gap is determined by the breadth of oscillation 16 of the polishing head 14. The space provides control of the polishing rate between annular segments of substrate 10 (see FIGS. 4–7) along with the ability to independently control belt speeds between at least two belts.

Figure 5:
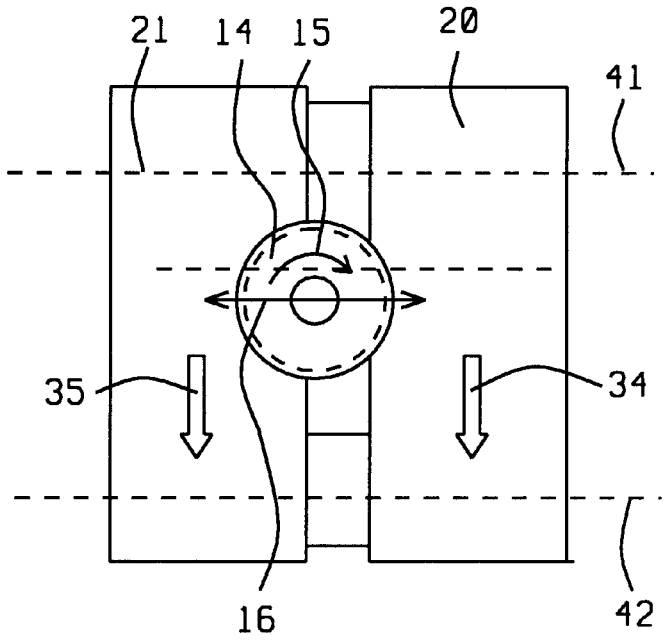
FIG. 5 is a schematic top view of FIG. 3 showing the polishing applications with a single polishing head.
Figure 6:
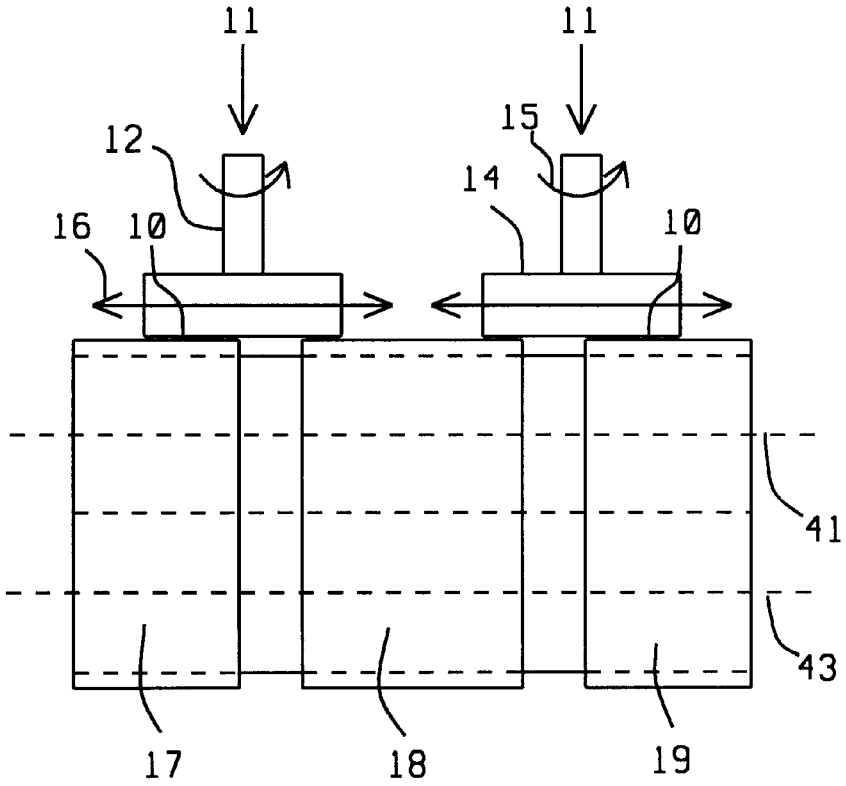
FIG. 6 is an illustration of a front view of the CMP tool of FIG. 2, showing three linear polishing belts.
Figure 7:
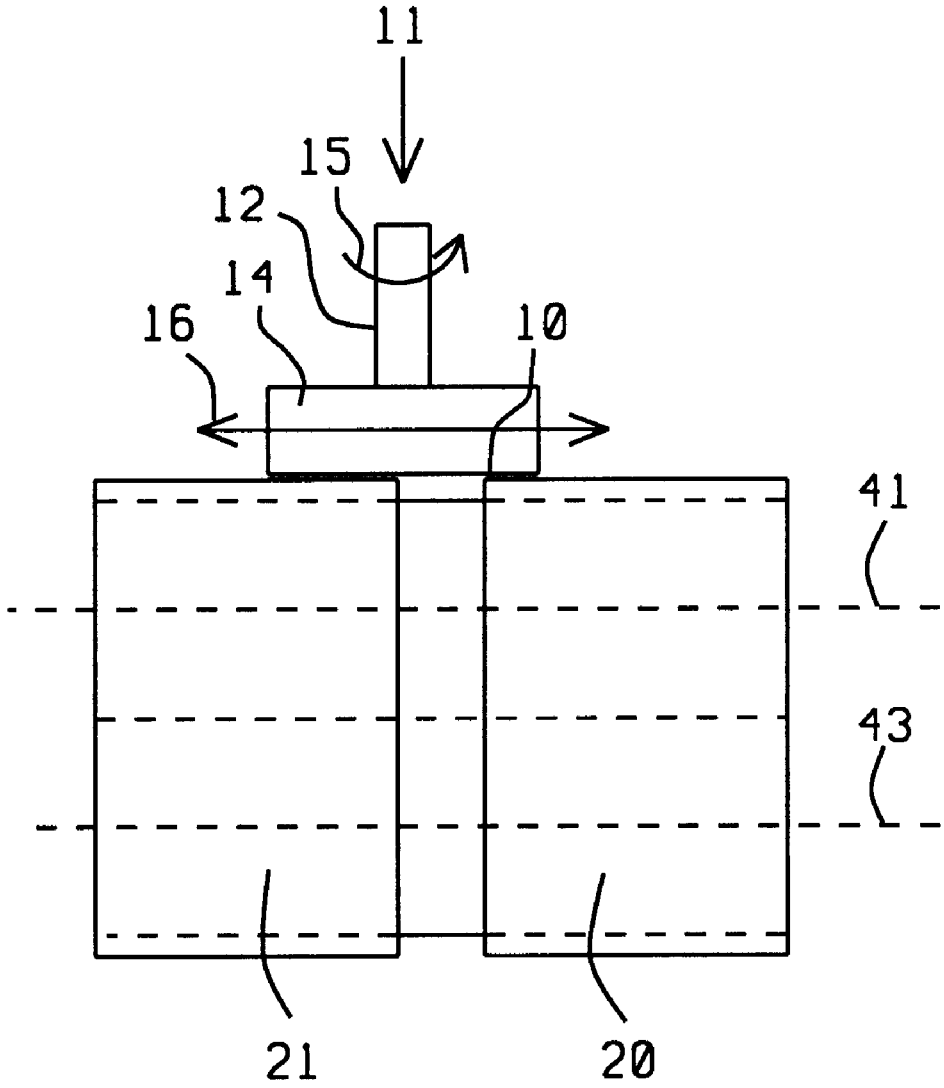
FIG. 7 is an illustration of a front view of a CMP tool of FIG. 3, showing a second embodiment of the invention.

In another embodiment, shown in FIGS. 3, 5 and 7, showing a polishing apparatus with two polishing belts 20 and 21 instead of three. All other features are the same with the exception of having only one polishing head 14 as shown in FIGS. 5 and 7.

The compactness of each embodiment is self evident along with the options provided by the apparatus of the invention. Therefore, it is intended that this invention encompass both of the embodiment as fall within the scope of the appended claims.

While the invention has been particularly shown and described with reference to the preferred embodiments thereof, it will be understood by those skilled in the art that various changes in form and details may be made without departing from the spirit and scope of the invention.

What is claimed is:

1. A linear polishing apparatus for polishing a semiconductor substrate, said apparatus comprising:

a substrate polishing head for holding, rotating, and oscillating said semiconductor substrate during polishing, and at least two polishing belts forming a continuous loop, said belts having an outside polishing surface and an inside driving surface;

said belts are spaced alongside each other and sharing a common axis at each end every belt looped around a pair of rollers, said pair consisting of a driver roller at one axis position, and a driven roller at the other;

a platen member interposing said belts is place between pairs of rollers, said platen providing a polishing plane and supporting surface for said polishing belts;

said polishing plane having a plurality of holes communicating with separate plenum chambers underlying said plane, said chamber supplies a compressed gas imparting regulated pressures against each polishing belt, and with at least two belts driven separately with variable speed drive motors.

2. The apparatus in accordance with claim 1 wherein said belt is looped around said rollers, is also looped around a driven idler roller that is adjustable in a downward direction for taking-up belt slack.

3. The apparatus in accordance with claim 1 wherein each driver roller is fixedly coupled to a rotating input shaft located at one axis, while each driven roller is free turning on the other rotating input shaft located at the other axis.

4. The apparatus in accordance with claim 1 wherein said variable speed drive motors are demountable coupled to each driver input shaft, said drive motors mounted on opposite sides and opposite ends of said rotating input shafts.

5. The apparatus in accordance with claim 4 wherein each drive motor having feedback means for adjusting the linear velocity for each polishing belt.

6. The apparatus in accordance with claim 1 wherein said polishing surfaces of each belt contain a polishing grit.

7. The apparatus in accordance with claim 1 wherein said compressed gas also provides a gas bearing interface to reduce friction between said platen and said driving surface of said polishing belts.

8. The apparatus in accordance with claim 1 wherein three polishing belts are assembled parallel to each other and separated by a predetermined gap.

9. The apparatus in accordance with claim 1 wherein said platen surface underlying each of the three belts has different hole arrays underlying each belt, and the linear velocity of each belt is variable.

10. The apparatus in accordance with claim 8 wherein the intermediate belt is driven and controlled independently with a separate variable speed motor.

11. A linear polishing method for polishing a semiconductor substrate, said method comprising the steps of:

providing a substrate to be planarized;

providing a substrate polishing head for holding, rotating, and oscillating said substrate during polishing;

providing a linear polishing apparatus having at least two polishing belts forming a continuous loop, said belts having an outside polishing surface and an inside driving surface, said belts are spaced alongside each other sharing a common axis at each end, each belt looped around a pair of rollers, said pair consisting of a driver roller at one end and a driven roller at the other end, a platen member interposing said belts, said platen is placed is placed between pairs of rollers, said platen providing a polishing plane and supporting surface for said polishing belts, said polishing plane having a plurality of holes communicating with separate plenum chambers underlying said plane, said chamber supplies a compressed gas to impart regulated pressures against each polishing belt, at least two of said belts are driven separately by variable speed drive motors.

12. The method in accordance with claim 11 wherein said belt is looped around said rollers, is also looped around an idler roller that is adjustable in a downward direction for taking-up belt slack.

13. The method in accordance with claim 11 wherein each driver roller is affixed to a drive shaft and each driven roller is free turning on said drive shaft.

14. The method in accordance with claim 11 wherein said drive shaft is demountably coupled to a variable speed drive motor, said drive motors arranged on opposite sides and opposite ends of said drive shafts.

15. The method in accordance with claim 14 wherein each drive motor having feedback means for adjusting the linear velocity for each belt during the polishing process.

16. The method in accordance with claim 11 wherein said polishing surfaces of each belt contain an abrasive polishing grit permanently bonded to said outside surface.

17. The method in accordance with claim 11 wherein said compressed gas also provides a gas bearing interface to reduce friction between said platen and said driving surface of said polishing belts.

18. The method in accordance with claim 11 wherein said polishing belts are assembled parallel to each other and separated by a predetermined gap dimension related to the extent of substrate oscillation for permitting different polishing rates to selected annulate substrate segments.

19. The method in accordance with claim 11, further comprising the steps of:

providing a polishing apparatus using a three-belt arrangement having two outer belts and an intermediate belt;

said two outer belts are driven and controlled by the same variable speed motor.

20. The method in accordance with claim 19 wherein the intermediate belt is independently driven and controlled by a separate variable speed motor.

21. The method in accordance with claim 11 wherein said polishing head oscillates between two of said belts having different polishing qualities, said breadth of oscillation is related to said gap between polishing belts.

22. The method in accordance with claim 21 wherein said belt polishing may be controlled by setting different linear speeds for each belt and/or varying the upward gas pressure under each belt.

23. The method in accordance with claim 11 wherein said substrate having an incoming concave profile which conventionally requires more polishing time for planarization is reduced substantially by increasing the linear speed of the belt making contact with said substrate's periphery.

24. The method in accordance with claim 11 wherein type of said polishing belts could be selected to be used with abrasive slurry.

25. The method in accordance with claim 24 wherein said type of polishing belts are selected from standard belts having different properties such as percent of rebound, hardness and compressibility.

* * * * *

UNITED STATES PATENT AND TRADEMARK OFFICE

CERTIFICATE OF CORRECTION

PATENT NO. : 6,726,545 B2
DATED : April 27, 2004
INVENTOR(S) : Subramanian Balakumar et al.

It is certified that error appears in the above-identified patent and that said Letters Patent is hereby corrected as shown below:

Title page,
Item [75], Inventors, delete "Victor Lim, Singapore (SG)", and replace with -- Victor Seng-Keong Lim, Singapore (SG) --.

Signed and Sealed this

Twenty-second Day of June, 2004

JON W. DUDAS
*Acting Director of the United States Patent and Trademark Office*